United States Patent [19]

Draxelmayr

[11] Patent Number: 4,733,160

[45] Date of Patent: Mar. 22, 1988

[54] CIRCUIT FOR GENERATING A REFERENCE VOLTAGE HAVING A PREDETERMINED TEMPERATURE DRIFT

[75] Inventor: Dieter Draxelmayr, Villach, Austria

[73] Assignee: Siemens Aktiengesellschaft, Berlin and Munich, Fed. Rep. of Germany

[21] Appl. No.: 907,986

[22] Filed: Sep. 16, 1986

[30] Foreign Application Priority Data

Sep. 17, 1985 [DE] Fed. Rep. of Germany ..... 3533165

[51] Int. Cl.[4] ..... G05F 3/20

[52] U.S. Cl. ..... 323/314; 323/281; 323/907

[58] Field of Search ..... 323/280, 281, 313, 314, 323/907

[56] References Cited

U.S. PATENT DOCUMENTS

| | | | |
|---|---|---|---|
| 3,617,859 | 11/1971 | Widlar et al. . | |
| 3,701,004 | 10/1972 | Tuccinardi et al. | 323/313 X |
| 3,781,648 | 12/1973 | Owens | 323/313 |
| 4,100,477 | 7/1978 | Tam | 323/314 |
| 4,490,669 | 12/1984 | Wilhelm | 323/313 |

FOREIGN PATENT DOCUMENTS 2018475 10/1979 United Kingdom .

OTHER PUBLICATIONS

Patents Abstracts of Japan, vol. 6, No. 34, Mar. 2, 1982, p. P-104 912; & JP-A-56 153 417, (Nippon Denki), FIGS. 3, 5.

Patents Abstracts of Japan, vol. 9, No. 250, Jun. 5, 1985, p. 394 1973; & JP-A-60 101 623, (Toshiba), FIGS. 2, 3.

Patent Abstracts of Japan, vol. 8, No. 153, Jul. 17, 1984, p. P-287 1590; & JP-A-59 52 320, (Matsushita); Mar. 26, 1984.

Semiconductor-Switching Technique, Fifth revised edition, (Tietze et al); pp. 386-390.

*Primary Examiner*—Peter S. Wong

*Attorney, Agent, or Firm*—Herbert L. Lerner; Laurence A. Greenberg

[57] ABSTRACT

A circuit for generating a reference voltage with a predetermined temperature drift includes a supply circuit; output terminals; a series circuit connected to the supply circuit and between the output terminals including a network and a circuit for generating an electrical variable having a positive temperature coefficient; and a regulator for negative feedback of an operating point setting having an input circuit connected to the circuit for generating an electrical variable having a positive temperature coefficient and an output circuit connected to the output terminals.

3 Claims, 3 Drawing Figures

Figure 3:
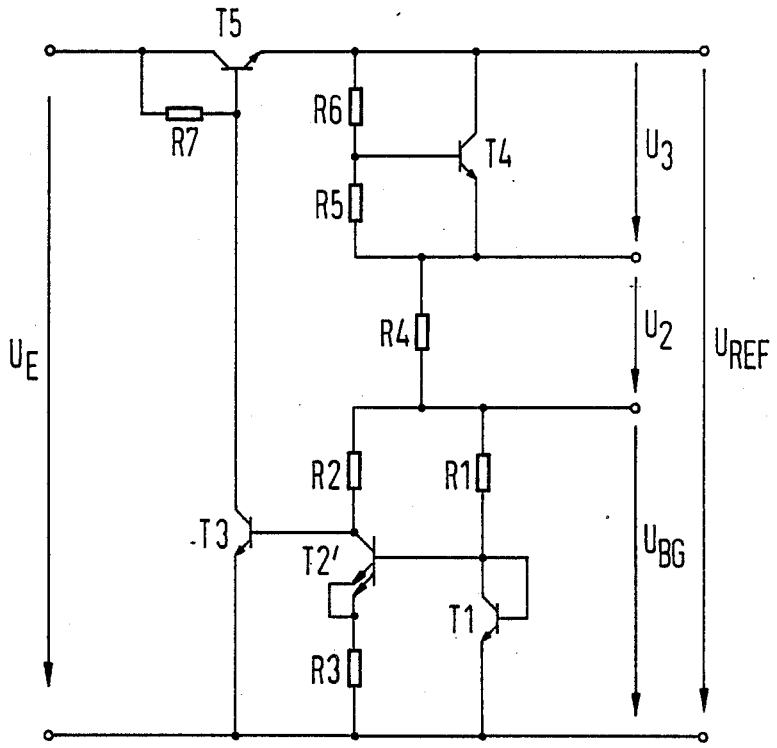

FIG 1
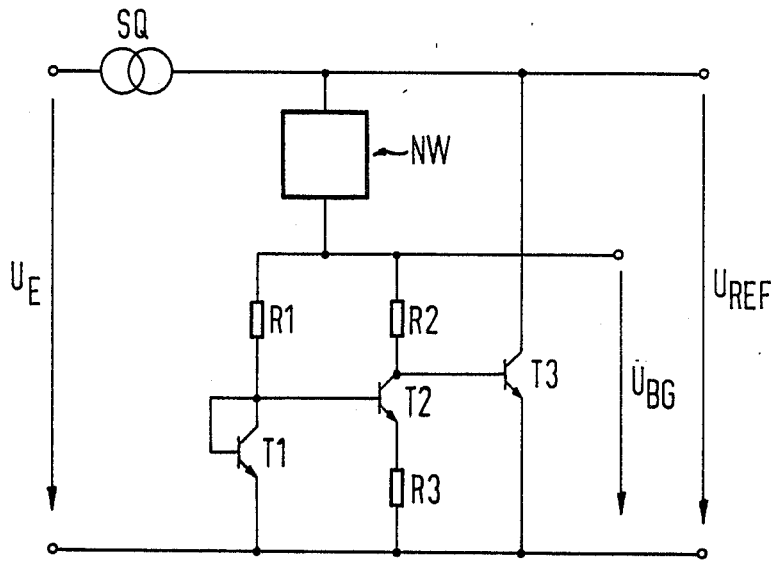
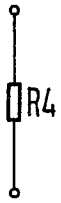
FIG.2(a)
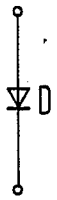
FIG.2(b)
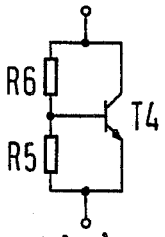
FIG.2(c)

CIRCUIT FOR GENERATING A REFERENCE VOLTAGE HAVING A PREDETERMINED TEMPERATURE DRIFT

The invention relates to a circuit for generating a reference voltage having a predetermined or specified temperature drift at the output terminals thereof, including a supply circuit, a circuit for generating an electrical variable having a positive temperature coefficient connected to an input circuit of a regulator for negative feedback of an operating point setting or position, the regulator having an output circuit connected to the output terminals.

In virtually all circuitry using integrated circuits, reference voltages are required. They are supposed to be constant under all operating conditions and should either have no temperature drift or a defined temperature drift. Band gap circuits are preferred for generating the reference voltages, especially in integrated circuits themselves. Band gap circuits are described, for example, in the book entitled "Halbleiter-Schaltungstechnik" [Semiconductor Circuitry] by U. Tietze and Ch. Schenk, 5th revised edition, published by Springer-Verlag Berlin, Heidelberg and New York, 1980, pp. 387 et seq.

In the above-mentioned publication, it is explained that by means of such band gap circuits, reference voltages can be generated that are independent of the temperature coefficient of the components used therein; that is, such a circuit furnishes a temperature-independent reference voltage, which corresponds to the band gap of the semiconductor material. For silicon, which is often used; this temperature-independent reference voltage is 1.205 V. In principle, such a circuit uses the base-to-emitter voltage of a transistor as a reference, the negative temperature coefficient of which is compensated for by the addition of a voltage having a positive temperature coefficient. This voltage is formed from the difference in the base-to-emitter voltages of two transistors driven with different currents.

An extension of a band gap circuit is known from U.S. Pat. No. 3,893,018, for example. In that patent, in addition to the band gap stage, two stabilized output voltages are generated with the aid of an extensive network including active and passive elements, one of the output voltages being correlated with a potential of the supply voltages at a time.

For generating a reference voltage different from the band gap voltage, conventional band gap circuit layouts require an extensive network, especially if a defined temperature drift is specified.

It is accordingly an object of the invention to provide a simple circuit for generating a reference voltage having a predetermined temperature drift, which overcomes the hereinafore-mentioned disadvantages of the heretofore-known devices of this general type.

With the foregoing and other objects in view there is provided, in accordance with the invention, a circuit for generating a reference voltage with a predetermined temperature drift at output terminals thereof, comprising a supply circuit; output terminals: a series circuit connected between the output terminals including a network and a circuit for generating an electrical variable having a positive temperature coefficient; and a regulator for negative feedback of an operating point setting or position having an input circuit connected to the circuit for generating an electrical variable having a positive temperature coefficient and an output circuit connected to the output terminals.

According to the invention, a network is connected in series with the circuit for generating an electrical variables having a positive temperature coefficient and is incorporated, through a regulator, into the negative feedback of the operating point setting of the circuit. The network that extends the regulating circuit is virtually free of restrictive conditions and permits the use of a variety of parameters in terms of both the absolute value of the reference voltage and its temperature drift, because the operating point setting has already been performed with the aid of the regulator, by the circuit for generating an electrical variable having a positive temperature coefficient.

In accordance with another feature of the invention, the network is formed of passive and/or active components.

In accordance with a further feature of the invention, the network is formed of an ohmic resistor.

In accordance with an added feature of the invention, the network is formed of a diode.

In accordance with an additional feature of the invention, the network is in the form of a transistor having an output circuit and a base, and an ohmic voltage divider connected in parallel with the output circuit of the transistor and having a divider point connected to the base of the transistor.

In accordance with again another feature of the invention, the circuit for generating an electrical variable having a positive temperature coefficient includes: a first branch having a first transistor connected as a diode with a base and a collector and a collector resistor connected to the collector of the first transistor; and a second branch parallel to the first branch having a second transistor with a base, and an output circuit with a collector and an emitter, a collector resistor connected to the collector of the second transistor and an emitter resistor connected to the emitter of the second transistor: the bases of the first and second transistors being interconnected.

In accordance with a concomitant feature of the invention, the regulator is a transistor having an output circuit delivering the reference voltage and a base connected to the collector of the second transistor.

Other features which are considered as characteristic for the invention are set forth in the appended claims.

Although the invention is illustrated and described herein as embodied in a circuit for generating a reference voltage having a predetermined temperature drift, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which:

FIG. 1, a schematic circuit diagram for a circuit layout or configuration for generating a reference voltage having a specifiable or predeterminable temperature drift:

FIG. 2 is a group of circuit diagrams to be used for practical embodiments of networks according to the invention; and FIG. 3 a circuit diagram of a practical embodiment of a circuit layout or configuration according to the invention.

Referring now to the figures of the drawings in detail and first, particularly, to FIG. 1 thereof, there is seen a circuit configuration or layout according to the invention for generating a reference voltage having a specifiable or predeterminable temperature drift, having a supply circuit which contains a current source SQ that is supplied by a terminal with a voltage $U_E$ relative to a reference potential. The circuit layout according to the invention is based on the band gap principle. A parallel circuit containing two branches is connected in series with a network NW. The first branch includes a transistor T1 connected as a diode and having a collector resistor R1, and the second branch of the output circuit includes the output circuit of a second transistor T2 having a collector resistor R2 and an emitter resistor R3. The base of the transistor T2 is connected to the base and the collector of the transistor T1. A further transistor T3 has an output circuit which is parallel to the above-described series circuit and parallel to output terminals having a reference voltage $U_{REF}$ of the circuit layout according to the invention. The base of the further transistor T3 is connected to the collector of the transistor T2.

On the assumption that the network NW, which is not described in further detail herein, represents a short circuit, the circuit layout of FIG. 1 corresponds to the band gap circuit described in the above-mentioned publication by U. Tietze and Ch. Schenk. The layout formed by the elements T1, T2 and R1–R3 represents a circuit for generating an electrical variable having a positive temperature coefficinet. This electrical variable is defined by the product of a resistor and an electrical current flowing through it, the dimension known as "voltage" being derived from this current.

A voltage that is amplified with the aid of the transistor T2 drops across the resistor R3. Again on the assumption of a short circuit of the network NW, the reference voltage $U_{REF}$, or a band gap voltage $U_{BG}$, is formed from the sum of the voltage dropping across the resistor R2, which has a positive temperature coefficient, and the base-to-emitter voltage of the transistor T3, which has a negative temperature coefficient. In this case, the transistor T3 functions as a regulating transistor, which is connected for voltage feedback through the resistor R2 and maintains a constant potential at the collector of the transistor T2.

On one hand, the network NW, which according to the invention includes passive and/or active elements, is incorporated into the negative feedback of the regulating transistor T3 in the circuit layout of FIG. 1. Since on the other hand, the network NW is in series with the circuit for generating an electrical variable having a positive temperature coefficient, the current flowing through the network NW is divided into the two parallel branches of the circuit with the same ratio as in the assumption that the network NW is a short circuit.

Given the fact that the current density through the transistor T1 must be greater than the current density through the transistor T2, the constant ratio of the two currents flowing through the parallel branches thus assures a constant voltage with a positive temperature coefficient at both the resistor R3 and the resistor R2. Thus the characteristics of the circuit for generating an electrical variable having a positive temperature coefficient are maintained despite the series-connected network NW according to the invention and regardless of the supply voltage. This is particularly applicable to the voltage drop $U_{BE}$ across the base-to-emitter junction of the transistor T1, to which the voltage drop across the resistor R1 is added, so that the unvaried band gap voltage $U_{BG}$, with respect to the reference potential, can be picked up at the connection of the two resistors R1 and R2.

The resultant temperature coefficient of the band gap voltage $U_{BE}$ can be varied substantially by means of the ratio of the current densities through the transistor T1 and T2, or their emitter area ratio, and by means of the resistor ratio R2/R1 and the resistor ratio R2/R3.

The reference voltage $U_{REF}$ to be generated according to the invention is derived by the addition of the band gap voltage UBG and the voltage dropping across the network NW. Possible embodiments of this network NW are shown in FIG. 2. FIG. 2*a* shows a purely ohmic or resistive resistor R4; FIG. 2*b* shows a diode D; and FIG. 2*c* shows a transistor T4, the output circuit of which is parallel to an ohmic voltage divider formed by resistors R5 and R6 and the base of which is driven by the divider point.

Accordingly, in a network NW according to the embodiment shown in FIG. 2, a voltage having a positive temperature coefficient in the case of FIG. 2*a*, and a diode flow voltage having a negative temperature coefficient in the case of FIGS. 2*b* and 2*c*, is added to the band gap voltage forming the additive components of the base-to-emitter voltage of the transistor T3 and the voltage dropping across the resistor R2 and having a positive temperature coefficient. In the case of FIG. 2*b*, the voltage having a negative temperature coefficient is added to its full extent, while in the case of FIG. 2*c* the base-to-emitter voltage of the transistor T4 is added in a weighted fashion by means of the voltage divider including the resistors R5 and R6.

The reference voltage at the output terminals of the circuit thus includes two components: one that is proportional to the base-to-emitter voltage having a negative temperature coefficient, and one that is proportional to the temperature voltage $U_T$, which is derived from the difference in the base-to-emitter voltages of the transistors T1 and T2 and has a positive temperature coefficient. Since these two components vary in inverse proportion to the temperature, a temperature compensation is attainable.

There are virtually no restrictive conditions placed on the network NW, because the setting of the operating points of the circuit for generating an electrical variable having a positive temperature coefficient is performed with the aid of the transistor T3 serving as a regulator. FIG. 3 shows an embodiment of a practical circuit for generating a reference voltage $U_{REF}$ at its output terminals, the temperature coefficient of which can be specified by the dimensioning of the circuit. Elements identical to those in FIGS. 1 and 2 are identified by the same reference numerals.

As shown in FIG. 3, the network NW includes a series circuit having an ohmic resistor R4 and the network shown in FIG. 2*c* described above. The transistor T2 of FIG. 1 is replaced in FIG. 3 by a transistor T2' having two or more emitters. The current source SQ includes a series pass transistor T5, the collector of which is connected to the supply terminal having the voltage $U_E$ relative to the reference potential and the emitter of which is connected with the output terminal having the reference voltage $U_{REF}$ relative to the reference potential. The transistor T5 is driven with the aid of a resistor R7, which is connected between the collector and the base of the transistor. Contrary to FIG. 1, the output circuit of the transistor T3 is connected through the base-to-emitter junction of the transistor T5 with the output terminals for the reference voltage $U_{REF}$.

The output voltage, that is the reference voltage $U_{REF}$, is additively composed of the band gap voltage $U_{BG}$, a voltage $U_2$ dropping across the resistor R4, and a voltage $U_3$ dropping across the collector-to-emitter junction of the transistor T4 or across the voltage divider formed of the resistors R5 and R6. These partial voltages are obtained by using the following equations, assuming that base currents are neglected, that voltage drops at base-to-emitter junctions are equated, and that a stable operating point exists:

$$U_{BG}=U_{BE}+R2/R3\cdot U_T\cdot 1n(n\cdot R2/R1)$$

$$U_2=U_T\cdot R4/R3\cdot(1+R2/R1)\cdot 1n(n\cdot R2/R1)$$

$$U_3=U_{BE}\cdot(1+R6/R5).$$

In these equations, n stands for the ratio of the emitter areas of the transistors T2 or T2' and T1, and $U_T$ is the temperature voltage obtained from the product of Boltzmann's constant and the absolute temperature, divided by the unit charge. The base-to-emitter voltages given, each refer to the particular associated transistor. The following expression for the reference voltage $U_{REF}$ is obtained:

$$U_{REF} = U_{BG} + U_2 + U_3 = U_{BE}\cdot(2 + R6/R5) + U_T\cdot \frac{R2 + R4\cdot(1 + R2/R1)}{R3}\cdot \ln(n\cdot R2/R1).$$

By specific manipulation, the proportionality factors found in this cumulative equation for the base-to-emitter voltage $U_{BE}$ or the temperature voltage $U_T$ permit both freely predeterminable or specifiable temperature drifts and an absolute value for the reference voltage $U_{REF}$. The absolute value for the reference voltage can be adjusted by the selection of the resistance values, independently of the temperature drift. Since only resistance ratios appear in the cumulative equation, the circuit layout according to the invention is largely independent of process-dictated variations in either the absolute resistance values or its temperature drifts, assuming that the resistor material is the same.

The embodiments according to the invention shown in FIGS. 1-3 are shown with n-p-n transistors. However, the invention is not limited to transistors of this type; on the contrary, a circuit layout according to the invention can also be attained with p-n-p transistors.

The foregoing is a description corresponding in substance to German Application No. P 35 33 165.8, dated Sept. 17, 1985, the International priority of which is being claimed for the instant application, and which is hereby made part of this application. Any material discrepancies between the foregoing specification and the aforementioned corresponding German application are to be resolved in favor of the latter.

I claim:

1. A circuit for generating a reference voltage with a predetermined temperature drift, comprising a supply circuit; output terminals; a series circuit connected to said supply circuit and between said output terminals including a network and a circuit for generating an electrical variable having a positive temperature coefficient, wherein said network includes at least one active component; and wherein said circuit for generating an electrical variable having a positive temperature coefficient includes: a first branch having a first transistor connected as a diode with a base and a collector, a first collector resistor connected to the collector of said first transistor, a second branch parallel to said first branch having a second transistor with a base, a collector and an emitter, a second collector resistor connected to the collector of said second transistor and an emitter resistor connected to the emitter of said second transistor, and said bases of said first and second transistors are interconnected, and a regulator with negative feedback for regulating an operating point setting having an input circuit connected to said circuit for generating an electrical variable having a positive temperature coefficient and an output circuit connected to said output terminals.

2. Circuit according to claim 1, wherein said network is in the form of a transistor having an output circuit and a base, and an ohmic voltage divider connected in parallel with said output circuit of said transistor and having a divider point connected to the base of said transistor.

3. Circuit according to claim 1, wherein said regulator is a transistor having an output circuit delivering the reference voltage and a base connected to the collector of said second transistor.

* * * * *